US007377335B2

(12) United States Patent
Jones et al.

(10) Patent No.: US 7,377,335 B2
(45) Date of Patent: May 27, 2008

(54) METHOD AND APPARATUS FOR MOVEMENT OF DRILLING EQUIPMENT BETWEEN ADJACENT LOCATIONS

(76) Inventors: Bruce Jones, 312, 407 - 2nd Street S. W., Calgary, AB (CA) T2P 2Y3; Robert Markle, 2900, 421 - 7th Avenue S. W., Calgary, AB (CA) T2P 2S5

( * ) Notice: Subject to any disclaimer, the term of this patent is extended or adjusted under 35 U.S.C. 154(b) by 0 days.

(21) Appl. No.: 11/851,690

(22) Filed: Sep. 7, 2007

(65) Prior Publication Data

US 2008/0006445 A1 Jan. 10, 2008

Related U.S. Application Data

(63) Continuation of application No. 10/734,993, filed on Dec. 12, 2003, now abandoned.

(30) Foreign Application Priority Data

Apr. 10, 2003 (CA) ..... 2425062

(51) Int. Cl.
*E21B 7/02* (2006.01)

(52) U.S. Cl. ..... 175/57; 175/220; 166/381; 166/75.11; 405/201

(58) Field of Classification Search ..... 175/57, 175/161, 108, 220; 166/381, 75.11, 85.5; 405/201

See application file for complete search history.

(56) References Cited

U.S. PATENT DOCUMENTS 4,068,487 A * 1/1978 Pease et al. ..... 405/201
5,407,302 A * 4/1995 Springett et al. ..... 405/196

* cited by examiner

*Primary Examiner*—Jennifer H. Gay
*Assistant Examiner*—Robert E Fuller
(74) *Attorney, Agent, or Firm*—Stites & Harbison, PLLC; David W. Nagle, Jr.

(57) ABSTRACT

An apparatus and method for the movement of drilling equipment between topographically adjacent drilling locations comprises positioning a transportable planar surface over the adjacent drilling locations between which it is desired to move the equipment. Ports or other access areas extending through the planar surface to the drilling locations below are provided. The equipment to be moved is placed on top of the planar surface and is provided on its bottom with a low-drag surface which can slide across the planar surface. The equipment can be moved from one desired drilling location to another by sliding it between locations on top of the planar surface. When all of the drilling is completed, the equipment can be struck for transport and the planar surface disassembled and moved to a new drilling area. Various methods to move the equipment could be used.

39 Claims, 12 Drawing Sheets

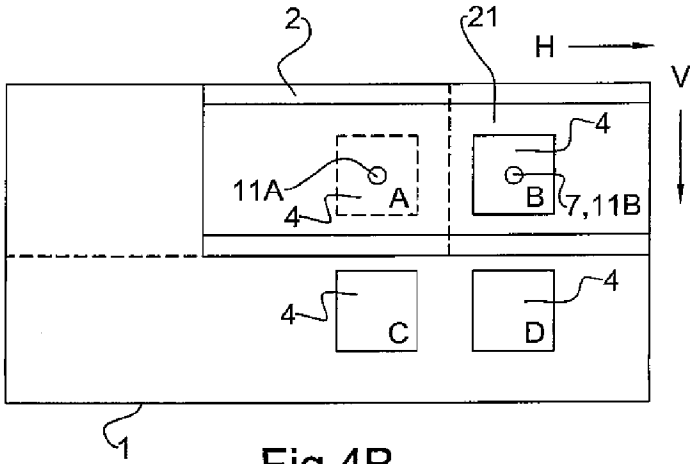
Fig.4A
Fig.4B
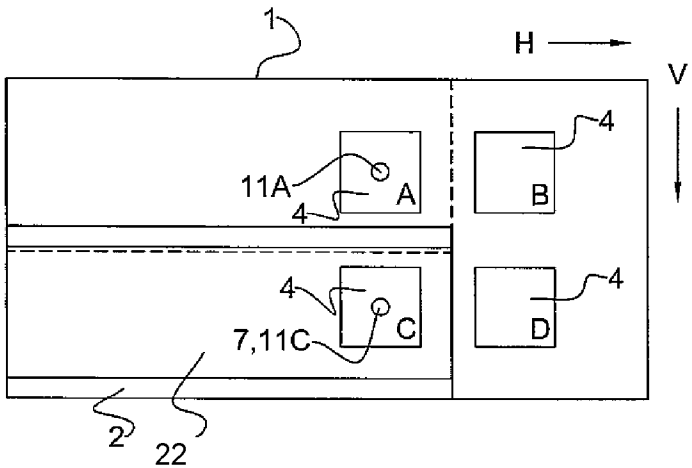
Fig.4C
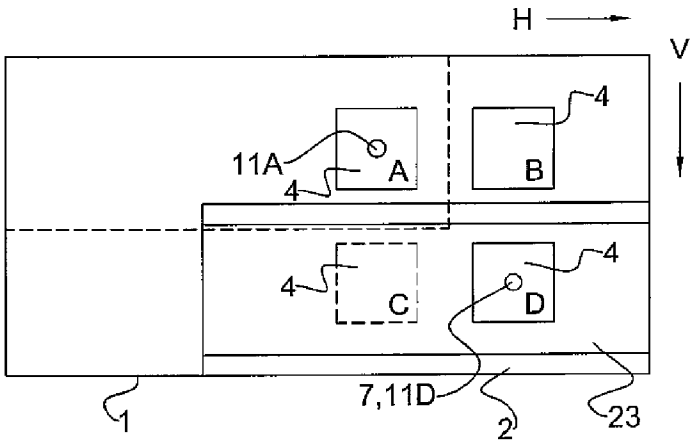
Fig.4D

METHOD AND APPARATUS FOR MOVEMENT OF DRILLING EQUIPMENT BETWEEN ADJACENT LOCATIONS

CROSS REFERENCE TO RELATED APPLICATIONS

The present application is a continuation of and claims priority from patent application Ser. No. 10/734,993, filed Dec. 12, 2003, and now abandoned.

FIELD OF THE INVENTION

This invention relates to the field of oilfield exploration and equipment and more particularly deals with methods and apparatus for the movement of heavy stationary drilling equipment between adjacent locations.

BACKGROUND

One of the many operational difficulties in oil and gas exploration activities is the movement of drilling rigs between drilling locations. For example it may be determined that within a relatively small geographic area there are two or more possible drilling locations, and once ranked in order of likelihood of success a drilling rig might be set up to first drill on one location and if satisfactory results are not achieved then the rig might be moved to the next preferred adjacent location and a new well drilled with the hope of achieving better results.

Certain exploration activities may also require the drilling of more than one well in close proximity and again the locations of those wells might be relatively close together (as in only a number of feet or yards apart). For example with directional drilling it is possible to drill holes that extend laterally in different directions from a relatively small geographic area on the surface.

Where conventional drilling equipment is used, drilling of the typical well would start with the erection of the rig equipment over the well center and then the well could be drilled. The typical conventional drilling rig would include a substructure and derrick which would be erected into position such that the well could be drilled below the derrick at the well center. The rig and equipment would also include other supporting or service outbuildings or ancillary equipment or supply tanks or racks, all of which would need to be appropriately positioned around the main substructure in order to properly drill the well.

If it is at some point determined that satisfactory results are not being achieved at that particular drilling site, or if it is otherwise required within the site drilling plan, it may be necessary or desirable to move the rig to an adjacent drilling position, or an adjacent well center, and try to drill again. As outlined above, in many cases these adjacent well centers could be in relatively close proximity but regardless of the close proximity or location of the adjacent proposed well center, where a conventional drilling rig was being used it would be necessary to disassemble a large portion of the equipment, including potentially taking down the derrick and taking apart other pieces of the substructure, moving the substructure and supporting equipment to the new well center and reassembling the remainder of the equipment. This is obviously a time intensive process which results in a relatively long period of time being required to move the rig between drilling sites. Also, given the significant degree of disassembly which is required in this type of the movement, the wear and tear on the drilling equipment itself from its movement between sites is increased.

Another alternative type of equipment which has been designed to make it easier to move the drilling rig between adjacent drilling locations are various types of rigs which allow for the lifting of the rig using hydraulic legs or the like, to disengage the rig from the ground surface, and then physically pushing the rig to the new location using heavy equipment or the like. While this to some extent will alleviate the problems associated with complete or nearly complete disassembly of a drilling structure to move it between adjacent drilling locations, it creates its own set of problems. For example, where the rig itself is to be lifted and then pushed or dragged into a new location, it is necessary to minimize, or at the very least be cognizant of issues related to, the overall weight of the drilling substructure and any remaining attachments when it is to be moved. For example, it is not possible in this type of a movement arrangement to keep large quantities of pipe in the derrick while the unit is moved, since the substructure needs to be properly engineered to accommodate the weight. There are also concerns associated with the types of equipment needed to push the equipment between locations as well as proper weight distribution of the entire device onto a relatively small surface area such as the bottom of a series of lifters or feet which might be used to lift the rig structure off of the ground surface.

This method of lifting and moving a rig between drilling locations has been tried in the other types of equipment as well, for example it is known that in certain cases a set of rails or the like has been disposed beneath the rig. Again the rig needs to be lifted from the ground and then moved along the rails, and then set back down at the new location. Lifting of the rig limits the weight which can be moved, and introduces great stability, safety and equipment wear concerns. Another problem with a rail movement arrangement is that the rig can only be moved in one direction, that is in a single linear direction such as forward and back, while it cannot be moved from side to side. There are also similar weight distribution issues with this type of a movement arrangement.

It would be desirable to be able to provide an apparatus and method for the movement of a drilling rig between adjacent drilling locations that overcame the limitations of the use of conventional drilling equipment related to the difficulties in moving those rigs between adjacent drilling locations, and also to potentially address the issues which are associated with other current methods of movement of drilling rigs which are specifically manufactured for the purpose of movement between adjacent drilling locations by lifting them from the earth and moving them in some fashion either by rails or by pushing or pulling them using heavy equipment or built-in motor systems.

SUMMARY OF THE INVENTION

It is the object of the present invention to provide an apparatus and method for moving a drilling rig from one drilling location to an adjacent drilling location that overcomes problems in the prior art. It is a further objective to provide such a method and apparatus that provides a pad to support a rig structure so that the rig structure can be moved horizontally along the surface of the pad.

In a first embodiment the invention provides a drilling apparatus capable of drilling in at least two drilling locations on a drilling surface. The drilling apparatus comprises a rig structure including a surface-engaging tool, the rig structure having a rig base and a drilling pad having a substantially planar rig support surface with at least one drilling location aperture passing therethrough. The pad can be placed on the drilling surface over the desired adjacent drilling locations such that each of the drilling locations coincides with a drilling location aperture. The rig base rests on the rig support surface. The rig structure can be positioned on the pad in a first position in alignment with a drilling location aperture such that the surface-engaging tool can pass through the drilling location aperture and access a first drilling location coinciding therewith; and the rig structure can be moved from the first position to a second position in alignment with a drilling location aperture such that the surface-engaging tool can pass through the drilling location aperture and access the second drilling location coinciding therewith by moving the rig structure horizontally across the rig support surface from the first position to the second position.

In a second embodiment the invention provides a drilling pad adapter apparatus allowing a rig structure to be movable between at least two adjacent drilling locations on a drilling surface,. The apparatus comprises a drilling pad comprising a substantially planar rig support surface with at least one drilling location aperture passing therethrough; and a rig base adapted for attachment to a bottom of the rig structure. The pad can be placed on the drilling surface over the desired adjacent drilling locations such that each of the drilling locations coincides with a drilling location aperture. The rig structure comprises a surface-engaging tool and the rig structure can be attached to the rig base resting on the pad and positioned in a first position in alignment with a first drilling location aperture such that the surface-engaging tool can pass through the drilling location aperture and access a first drilling location coinciding therewith. The rig structure attached to the rig base can be moved from the first position to a second position in alignment with a second drilling location aperture such that the surface-engaging tool can pass through a drilling location aperture and access a second drilling location coinciding therewith, by moving the rig structure attached to the rig base horizontally across the rig support surface from the first position to the second position.

In a third embodiment the invention provides a method of moving a rig structure on a drilling surface between adjacent drilling locations comprises providing a drilling pad having a substantially planar rig support surface with at least one drilling location aperture passing therethrough. The drilling pad is placed on the drilling surface over desired adjacent drilling locations such that each desired drilling location coincides with a drilling location aperture. A rig structure is placed on the rig support surface, the rig structure including a surface-engaging tool. The rig structure is moved horizontally across the rig support surface until the rig structure is aligned with a selected drilling location aperture coinciding with a desired drilling location such that the surface-engaging tool can access the desired drilling location through the selected drilling location aperture.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

FIG. 4A illustrates the embodiment of FIG. 3 with the rig base in a first position A;

FIG. 4B demonstrates the embodiment of FIG. 3 with the rig base in a second position B;

FIG. 4C demonstrates the embodiment of FIG. 3 with the rig base in a third position C;

FIG. 4D demonstrates the embodiment of FIG. 3 with the rig base in a fourth position D;

DETAILED DESCRIPTION OF THE ILLUSTRATED EMBODIMENTS:

The method and apparatus of the present invention are directed to the provision of a movable drilling rig structure which can be moved between adjacent drilling locations without the need to disassemble or lift the derrick, substructure or other surrounding equipment.

General Apparatus:

The method and apparatus of the present invention are directed to the provision of a movable drilling rig structure which can be moved between adjacent drilling locations without the need to disassemble the rig structure or other surrounding equipment.

In terms of describing the apparatus and method of the present invention it will first of all be appropriate to understand the concept of adjacent drilling locations. As described in some detail above, it may in certain circumstances be desirable to move the drilling rig from one drilling location or well center onto another drilling location or well center which is an adjacent location, from which the second well can be drilled. It may also be desirable to be able to move a drilling rig or derrick between a plurality of such drilling locations in the course of one particular drilling job or at one general drilling sites or area. It is the method and apparatus for movement of the drilling rig itself between these adjacent drilling locations to which the present invention is directed.

The first component of the apparatus of the present invention is a pad [1]. The pad [1] provides an approximately planar rig support surface [3] on the top surface of the pad [1] upon which the rig structure [6] itself can rest. The figures of this disclosure show the pad [1] being rectangular in shape. It will be understood that if a different pattern of drilling locations or well centers was desired, or if it was desired to cover or accommodate drilling sites or locations of varying shapes or sizes that a pad [1] of a different shape could be made without departing from the scope or intention of the present invention.

Figure 1:
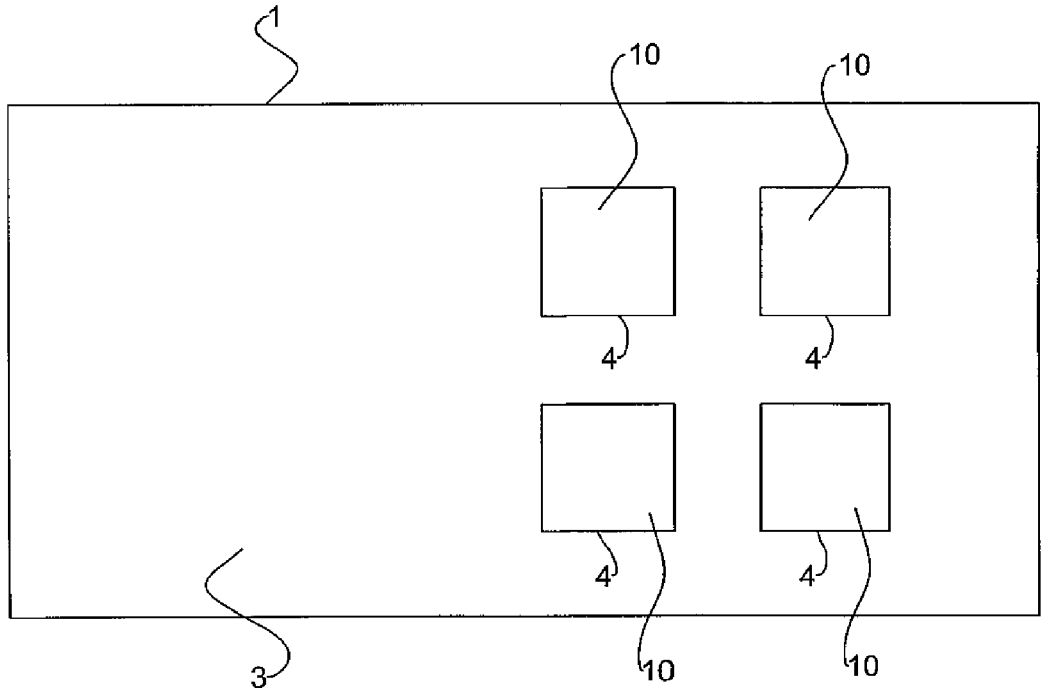
FIG. 1 is a top view of one embodiment of a rig pad of the present invention.

FIG. 1 shows a top view of one embodiment of a pad [1] of the present invention. In the embodiment of FIG. 1, there are four closely spaced drilling location apertures [4] shown, disposed in a grid pattern near one end of the pad [1]. The drilling location apertures [4] provide an access area through the rig support surface [3] of the pad [1] extending down to a drilling surface [10] beneath the pad [1], through which a rig structure resting on the rig support surface [3] can reach down to the drilling surface [10] below.

The placement of the drilling location apertures [4] in the embodiment of FIG. 1 was determined by the approximate shape of the typical substructure of an existing conventional drilling rig structure. It will be understood however that the placement of the drilling location apertures [4] could really be anywhere on the rig support surface [3] of the pad [1], provided that there was sufficient room on the rig support surface [3] surrounded the drilling location aperture [4] in question to allow for the proper positioning of the rig base over top of the drilling location aperture [4] in question.

Figure 2:
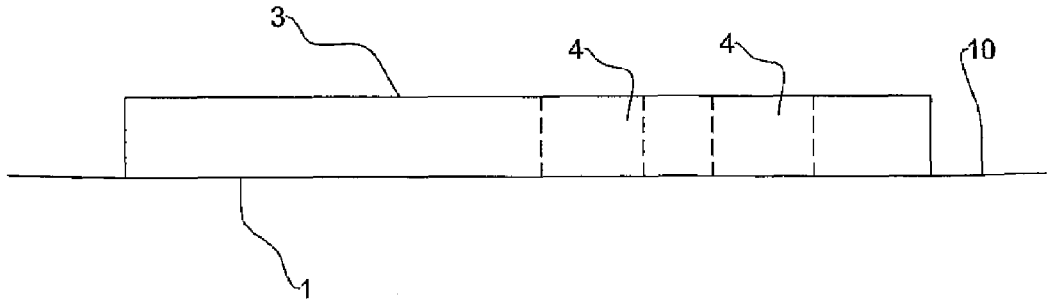
FIG. 2 is a side view of the pad of FIG. 1.

Drilling location apertures [4] would be placed anywhere through the pad [1] where it would be desired to drill through. FIG. 2 shows a side view of the pad [1] of FIG. 1. The extension of the drilling location apertures [4] through the pad [1] is shown in dotted relief in FIG. 2.

In terms of on-site set up, the most essential issue in the assembly of the drilling apparatus of the present invention would be the proper placement of the pad [1] on the drilling surface [10], so that the drilling location apertures [4] were properly located over the precise topographical locations or drilling locations at which it was desired to potentially drill. Once the pad [1] was properly placed, and the rig structure was assembled thereon, the equipment could be moved around on the rig support surface [3] of the pad [1] to the appropriate open drilling location aperture [4] through which it was desired to drill. Typically in practice conductor pipe will be placed at the desired drilling locations prior to placing the pad [1] in position. The drilling location apertures [4] will be oriented on the pad to coincide with the drilling locations, either by placing the conductor pipes in an orientation corresponding to the drilling location apertures [4] on a pad [1] that it to be used, or by providing variable aperture placement in the pad such that the conductor pipe locations can be accessed therethrough.

Figure 5:
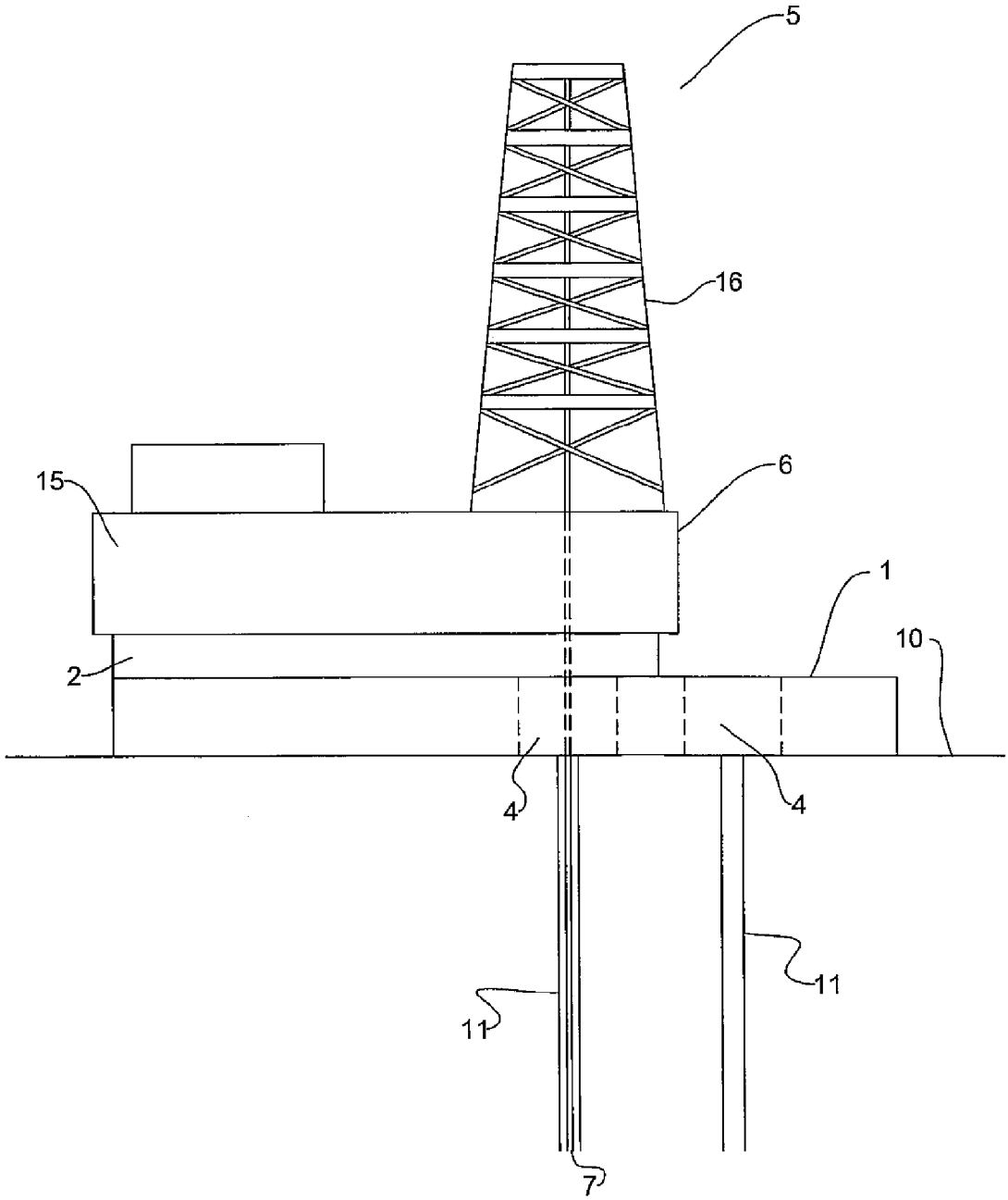
FIG. 5 is a side view of the embodiment of FIG. 3, showing a derrick and rig substructure in place on the rig base.

As seen in FIG. 5, once the pad [1] is placed on the drilling surface [10], the next piece of the rig apparatus [5] of the present invention which would be added would be the drilling rig or rig structure [6] which it was desired to use at the site in which it was desired to employ the method and apparatus of the present invention to quickly and easily move between drilling locations [11]. As will be discussed in further detail below, a specific rig structure [6] might be employed with the pad [1] of the present invention, or alternatively many conventional drilling rig structures [6] could be retrofit or otherwise modified to be used in accordance with the present invention. A rig base [2] might be used either as a separate component, in the case of a retrofitted conventional piece of equipment, or the bottom surface of the rig structure [6] itself could be adapted to be used as the rig base [2].

The key to the rig base [2], whether that be a separate component used to retrofit a conventional drilling rig structure [6], or whether there was a specific drilling rig structure [6] manufactured for use with the pad [1] and other components of the present invention, would be that the bottom surface of the rig base [2], coupled with the rig support surface [3] of the pad [1] would cooperate in a low friction relationship such that the equipment on the top of the rig base [2] could be effectively "slid" around on the rig support surface [3] of the pad [1] without needing to lift the rig structure [6]. Stability would be maintained by removing the need to lift the rig structure [6].

It will be understood that any type of a rig base [2] which accomplished the object of allowing for the movement of a piece of equipment about on the rig support surface [3] of the pad [1] would be contemplated within the scope of the present invention.

Figure 3:
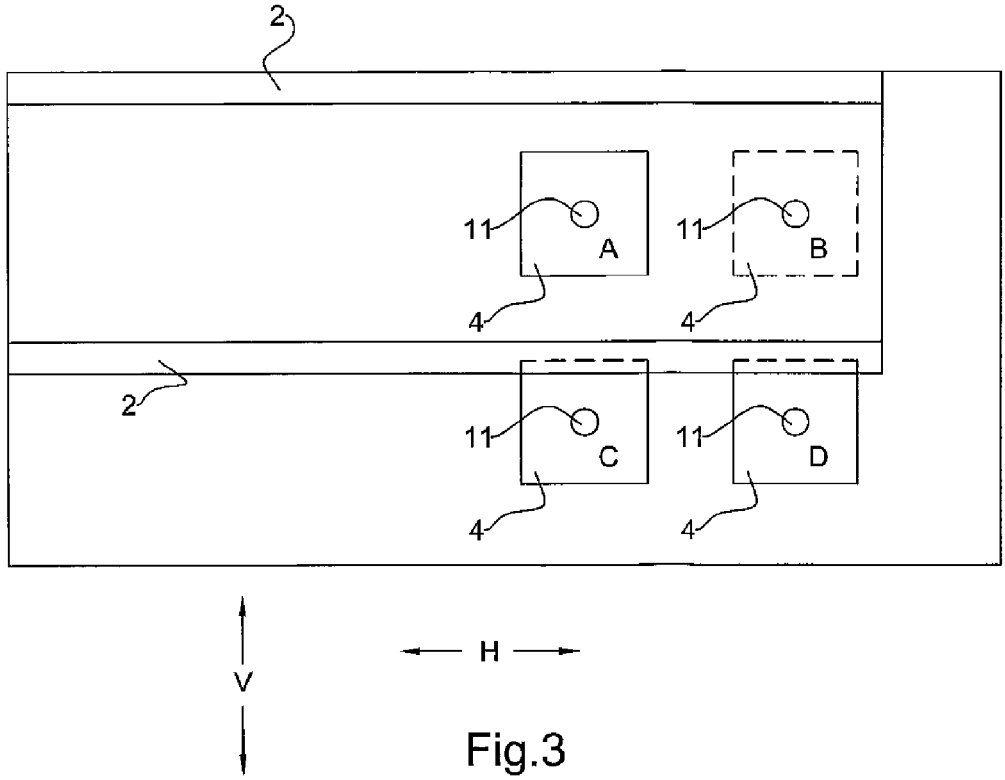
FIG. 3 is a top view of the embodiment of the pad of FIG. 1, also showing a rig base on the pad.
Figure 13:
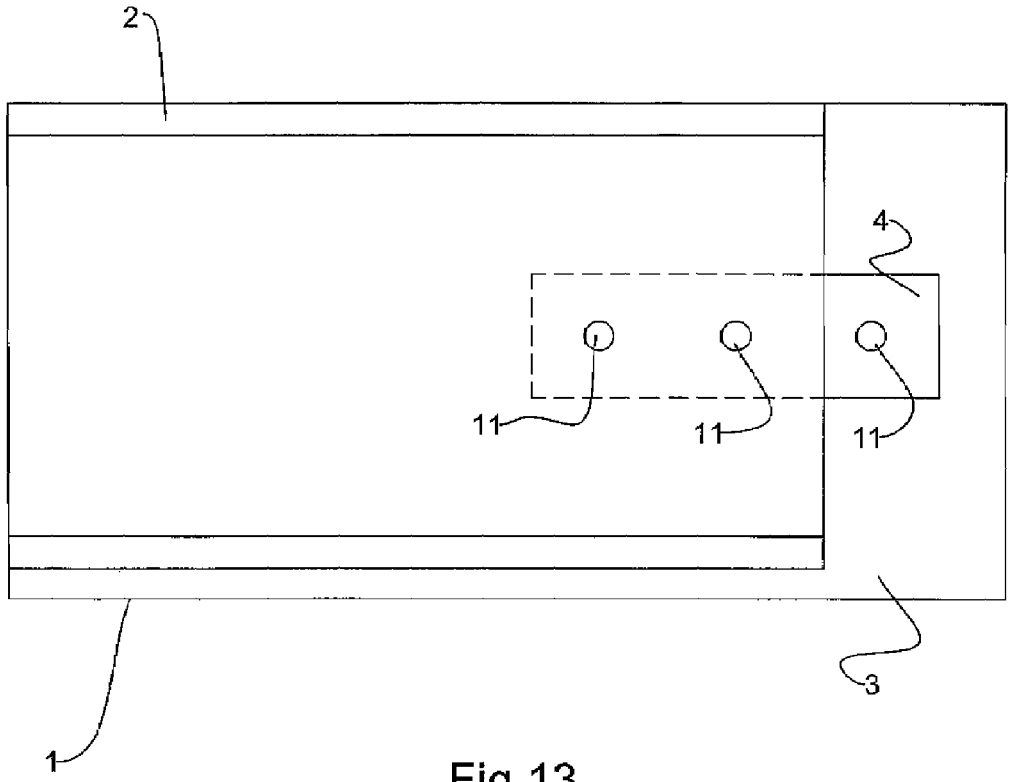
FIG. 13 illustrates one embodiment of the pad consisting of only one drilling location aperture.

FIG. 3 demonstrates one embodiment of the pad [1] of the present invention, such as a shown in FIG. 1 and FIG. 2, with a rig structure comprising a rig base [2] positioned on the pad [1]. The pad [1] which is shown in FIG. 3 is a pad [1] similar to that shown in FIG. 1 insofar as there are four drilling locations [11] coinciding with four drilling location apertures [4] shown thereon nearer to one end of the pad [1]— these are lettered A through D for reference. Again in FIG. 3, the placement of the drilling location apertures [4] closer to one end of the pad [1] is related primarily to the positioning of the derrick [16] and other equipment on the typical oil rig structure [6] at one end of the substructure [15] as illustrated in FIG. 5. It will be understood that the drilling location apertures [4] could be located anywhere on the pad [1] again so long as the rig base [2] is capable of properly locating the drilling tool or surface-engaging tool [7] in question over top of a desired drilling location aperture [4]. Also it is contemplated in the present invention that a pad [1] may contain only one drilling location aperture [4] that allows access to more than one drilling location [11] as illustrated in FIG. 13.

In FIG. 4A, the rig base [2] is positioned in a first position [20] aligned with a first drilling location [11A] coinciding with a first drilling location aperture A. In FIGS. 4A to 4D the surface-engaging tool [7] is indicated as coinciding with the particular drilling location that can be drilled with the base [2] oriented as indicated. A second drilling location aperture B and a coinciding second drilling location [11B], shown in FIG. 4B, could be accessed by the rig structure [6] by sliding the rig base [2] from the first position [20] towards the other end of the pad [1] in direction H to a second position [21] aligned with the second drilling location [11B].

Alternatively, from the first position [20] coinciding with the first drilling location aperture A, the rig structure [6] could be moved to an alternate third position [22] aligned with an alternate third drilling location [11C] coinciding with alternate third drilling location aperture C, shown in FIG. 4C, by sliding the rig base [2] down in direction V. Alternatively, a different fourth position [23] aligned with a different fourth position [1 ID] coinciding with a different fourth drilling location aperture D, shown in FIG. 4D, could be accessed by the rig structure [6] by sliding the rig structure [6] down and over in both directions H and V. Referring to the pad [1] and the rig base [2] shown in FIG. 4A, FIGS. 4B through 4D show the rig base [2] in the four possible positions [21, 22, 23] coinciding with the four possible drilling location apertures, respectively. Effectively the four positions of the rig base [2] shown in these FIGS. are the four quadrants of the pad [1]. It is contemplated by the present invention that the first drilling location [11A] and its coinciding first drilling location aperture A does not have to be at the location shown in FIG. 4A, but could be any drilling location [11].

FIG. 5 shows a rig apparatus [5] mounted on the base [2] and demonstrates the rig structure [5] and the approximate location of the elements of the rig structure [6] including, the derrick [16], the remainder of the rig substructure [15] and the surface-engaging tool [7] in relation to the drilling locations [11] and the drilling surface [10].

Method of Rig Movement:

Various apparatus and methods which could be used to actually move the rig structure [6] or drilling equipment on the rig support surface [3] of the pad [1], between drilling locations [11], can be contemplated. In the simplest possible embodiments, the rig structure [6] might actually just be moved around on the rig support surface [3] of the pad [1] using winches or heavy equipment to drag the rig structure [6] around on the rig support surface [3] of the pad [1]. Various more methodical or mechanical methods of movement can also be contemplated. It will be understood however that this simplest method of movement of the rig structure [6] between a first drilling location [11A] and a second drilling location [11B] on the rig support surface [3] of the pad [1], would be by disengaging the surface-engaging tool [7] from the drilling surface [10] through the present drilling location aperture [4] and then basically dragging the rig structure [5] or the rig base [2] around on the rig support surface [3] of the pad [1] to the second position [21] aligned with the second drilling location [11B] such that the surface-engaging tool [7] can be reengaged with the drilling surface [10] through a drilling location aperture [4] coinciding with the second drilling location [11B]. Using winches or other equipment on or adjacent to the pad [1], is contemplated within the scope of the apparatus and method of the present invention insofar as the creation of an apparatus or a low friction relationship between a rig base [2] and the rig surface [3] of the pad [1] such as is contemplated herein, regardless of the method of power used to move the rig base [2] or rig structure [6] in this fashion, is novel and it is intended to be contemplated within the scope of the present invention.

One particular method of moving the rig structure [6] about on the rig support surface [3] of the pad [1] might involve the use of hydraulic cylinders to "push" or "pull" the equipment, on the rig base [2], about on the rig support surface [3] of the pad [1]. Other methods of hydraulic power or hydraulic movement could also be contemplated, involving pushing the rig base [2] about the rig support surface [3] of the pad [1] from fixed points on the surface of the pad [1], or alternatively by providing a drive mechanism on the rig structure [6] itself which could "pull" the rig base [2] about on the rig support surface [3] of the pad [1].

Figure 11:
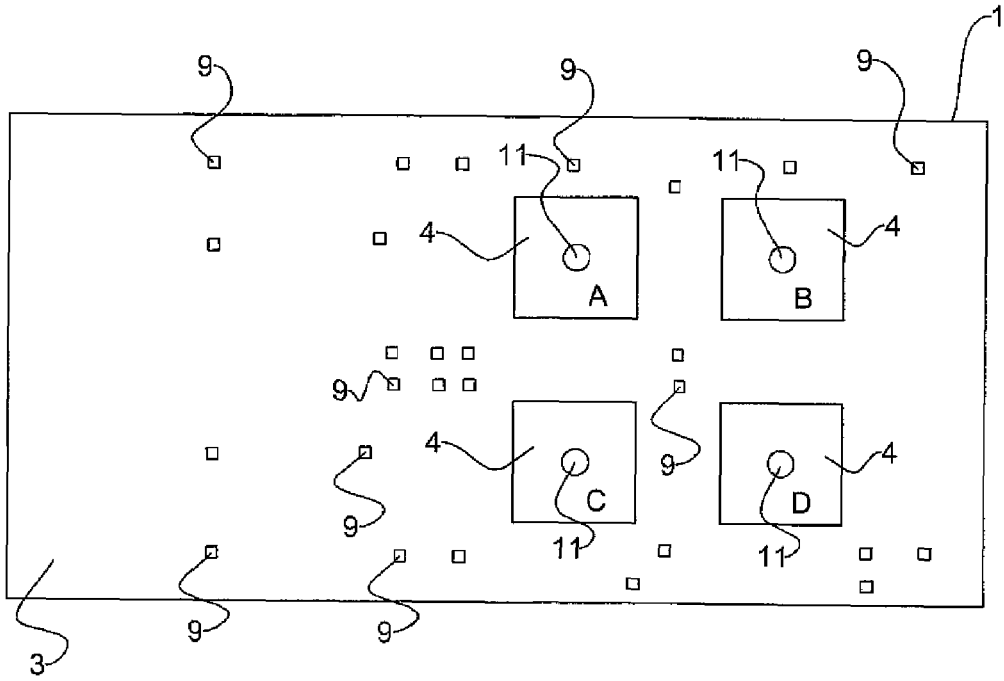
FIG. 11 shows the pad of FIG. 1 with anchor points thereon to allow for hydraulic cylinder movement of a rig structure thereon.
Figure 12A:
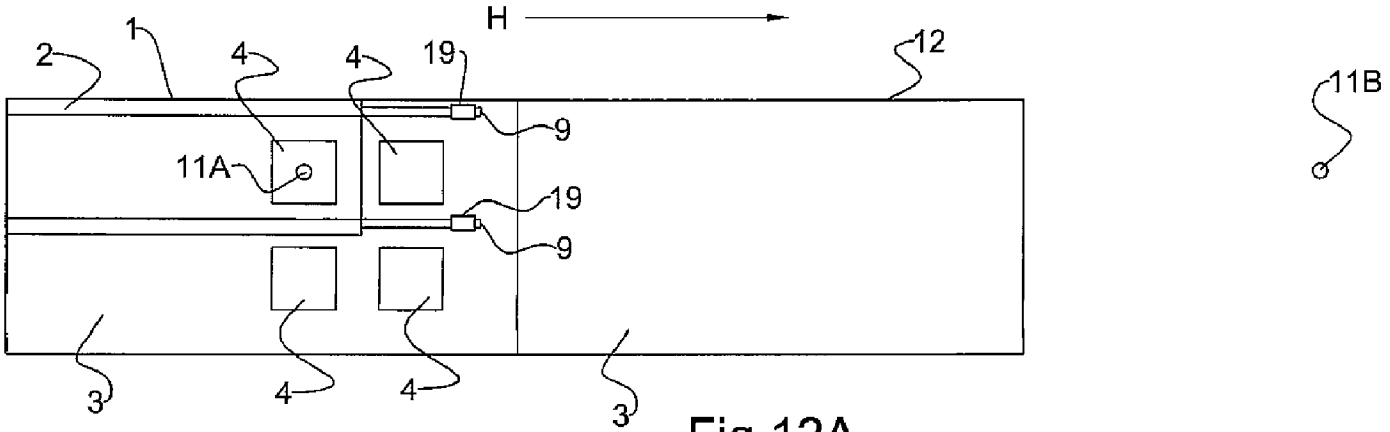
FIG. 12A shows another embodiment of the invention, wherein two pads are connected end to end resulting in a longer degree of end to end movement being available to the rig between drilling locations where one of the pad has an non-perforated surface and the rig base is located at a position A.

Referring to FIG. 11 there is shown an embodiment of the present invention using a pad [1] with four drilling location apertures [4] extending their through. On the rig support surface [3] of the pad [1], there are shown a number of anchor points [9] to which hydraulic cylinders can be anchored at one end. The other end of such a hydraulic cylinder [19] can be anchored to a pin point on the rig base [2], as illustrated in FIG. 12A, and then by extension or retraction of the hydraulic cylinder or cylinders in question, the rig base [2], and any equipment attached thereto, would be horizontally maneuvered about on the planar rig support surface [3] of the pad [1]. It may be necessary in the course of a move of the rig base [2] from a first position to a second position on the rig support surface [3] of the pad [1] to move the rig structure part way to the second position and then detach the hydraulic cylinders and reattach them to a new set of anchor points [9] either on the rig base [2], or on the rig support surface [3] of the pad [1], and then continued movement of the rig structure [6] or the rig base [2] in relation to the pad [1] could be accomplished by continued manipulation of the hydraulic cylinders. It is contemplated that in a simple embodiment, two hydraulic cylinders [19] could be used to manipulate the entire rig structure [5] about on the upper surface [3] of the pad [1].

Retrofitting the Apparatus to Conventional Drilling Rigs:

One of the prime benefits of the system of the present invention is that it can provide an adapter for use with a conventional drilling rig, rather than requiring the use of a specific type of rig substructure or drilling apparatus to accomplish the benefits offered by the present invention. Not only will this make it easier to continue to use older or legacy drilling equipment with the new method of the present invention, it will also provide great flexibility in terms of the particular types of drilling or exploration that can be undertaken with this type of device or method. For example drilling rigs or drilling equipment used in different types of drilling, such as for gas, oil, water or other types of materials could all be used in this type of apparatus or method. The adapter provides a pad [1] and a rig base [2] adapted to attach to the rig structure [5] to allow the rig to move about on the pad [1].

The apparatus of the present invention allows for the use of conventional drilling rigs or other legacy equipment in quite a simple fashion. Basically, rig base [2] is produced or attached to the existing rig structure [6] or the like and the major requirement for the rig base [2] is to be capable of sliding on the rig support surface [3] of the pad [1] so that the rig base [2] and the attached rig structure [6] or substructure [15] there above can be moved about on the rig support surface [3] of the pad [1] between various drilling locations [1 1] located thereon.

Figure 6A:
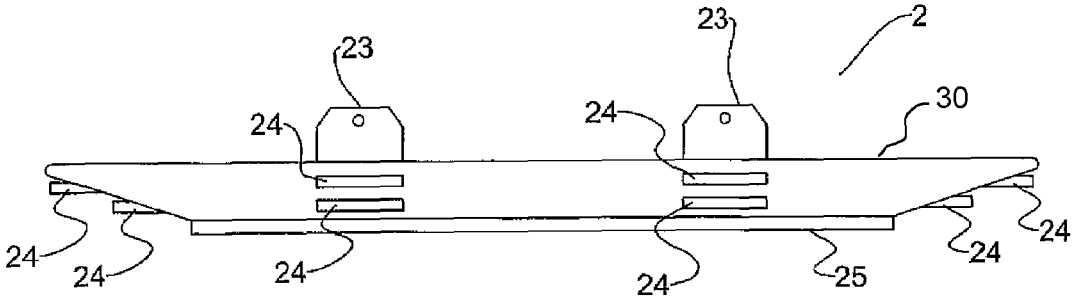
FIG. 6A is a side view of an embodiment of a rig base that is a pontoon.
Figure 6B:
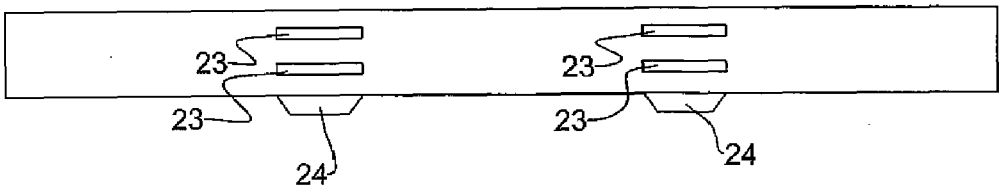
FIG. 6B is a top view of an embodiment of a rig base that is a pontoon.
Figure 6C:
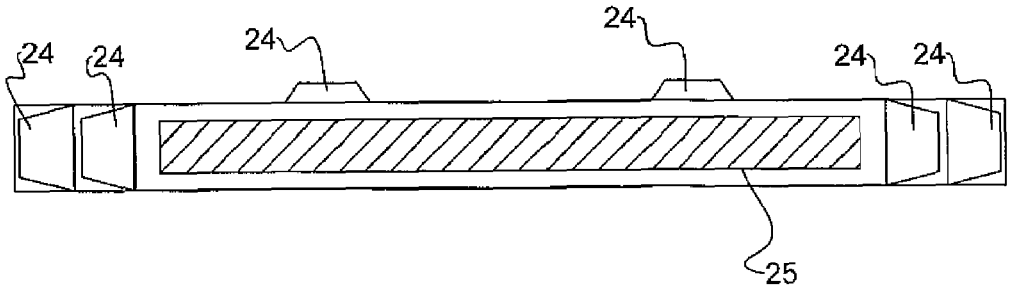
FIG. 6C is a bottom view of an embodiment of a rig base that is a pontoon.

FIGS. 6A-6C illustrate a rig base [2] which has been fashioned into pontoons [30], corresponding with one embodiment of the invention. These pontoons [30] can be attached to the existing substructure [15] of an existing drilling rig using drilling rig attachment points schematically illustrated at [23]. These pontoons allow for an appropriate distribution of the weight of the substructure [15] across the pad [1]. The pontoons [30] provide a flat bottom that distributes the weight of the rig structure [6] across a significant portion of the rig support surface [3] of the pad

[1]. If hydraulic cylinders are used to move the rig structure [6], the rig base [2] can be provided with hydraulic ram attachment points [24].

The rig base [2] illustrated in FIGS. 6A-6C could be further enhanced by providing a low friction coating [25] on the bottom of the rig base [2] thereof which would further facilitate the movement of the rig structure [6] on the pad [1]. For example, an ultra high molecular weight polymer surface on the bottom of the pontoons provides one example of a low friction surface which would lend itself to use in the method and apparatus of the present invention.

It will be understood that the pontoons which are discussed herein would only be one possible type of rig base [2]. It may even be the case that a typical drilling rig structure [6] of a conventional style may just be set down on the pad [1], and the bottom surface of the existing substructure of the rig would then become the rig base [2] in terms of this disclosure. Again, that surface might then be augmented or optimized for use in accordance with the method of the present invention by adding some type of a low friction surface thereto but it will be understood the particular type of a rig base [2] which has the effect of allowing for the movement of the rig or other equipment attached thereto about on a pad [1] between various locations on the pad [1] will be contemplated within the scope present invention.

Portability of the Apparatus:

One of the major benefits of the apparatus of the present invention, in addition to the great simplicity with which rig structure [6] moves between a first drilling location [11A] and a second drilling location [11B] can be accomplished, is the portability of the entire rig apparatus [6]. As has been outlined above, the apparatus of the present invention can either be retrofitted to a typical conventional drilling rig apparatus, or a specific rig substructure might also be designed to be used in accordance with the method and apparatus of the present invention. In either case, the apparatus of the present invention where a conventional drilling rig was used would basically consist of whatever rig base [2] was designed to attach to the typical rig substructure [ 15] and which rig base [2] could then slide upon the rig support surface [3] of the pad [1]. In the figures shown, the rig base [2] is a pair of pontoons [30] which can be fitted to the substructure [15] of a rig structure [6] and set down upon the pad [1]. Obviously these pontoons [30] are simply transportable, given the transportability of the remainder of the far larger and more complex equipment involved in a typical drilling site.

Figure 10:
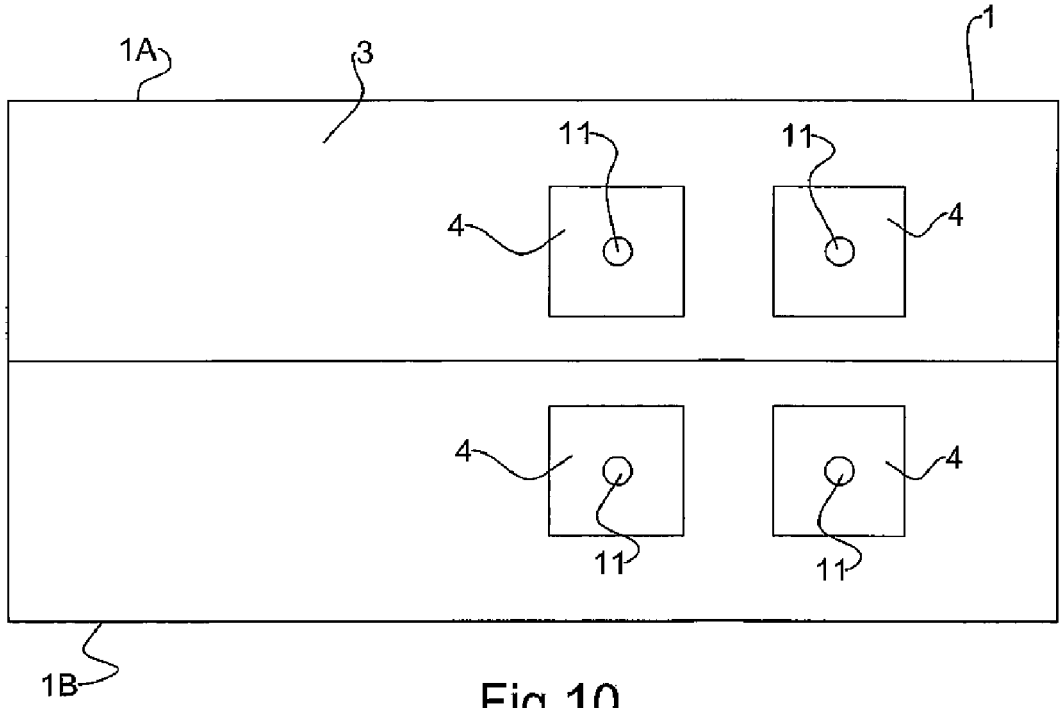
FIG. 10 shows another embodiment of a pad which is dividable for transport.

The second piece of apparatus of the present invention which is also easily rendered transportable is the pad [1]. The pad [1] might be transported simply by packing it up onto a trailer or the like, if it was of a size or shape that could be easily transported without a further breakdown. Alternatively, the pad [1] could be made transportable by manufacturing it in more than one piece which could then be bolted together on the site when the rig apparatus [5] of the present invention was assembled for use. For example FIG. 10 shows a pad [1] built in two smaller rectangular connectable portions [1A] and [1B], each of which would approximately fit on a flatbed trailer or the like for transport, and these two connectable portions could then be bolted together at the drilling site to render the complete, full-sized pad [1].

Figure 8:
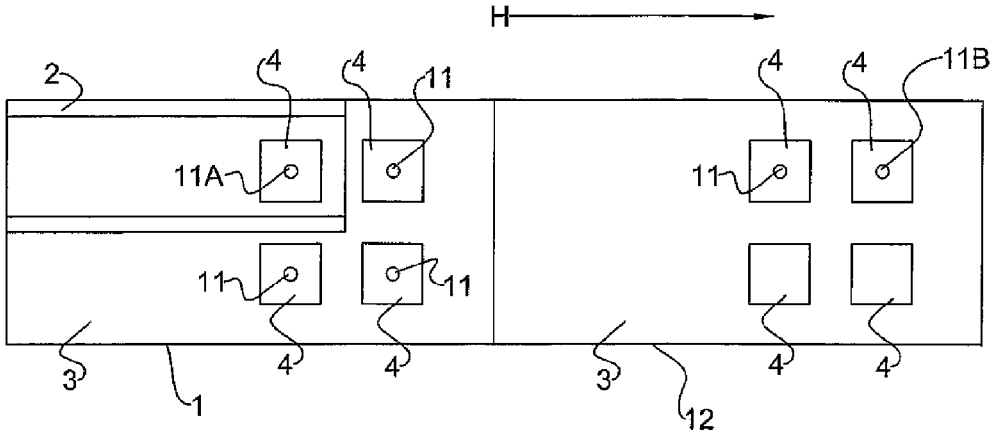
FIG. 8 shows another embodiment of the invention, wherein two pads are connected end to end resulting in a longer degree of end to end movement being available to the rig between drilling locations.
Figure 9:
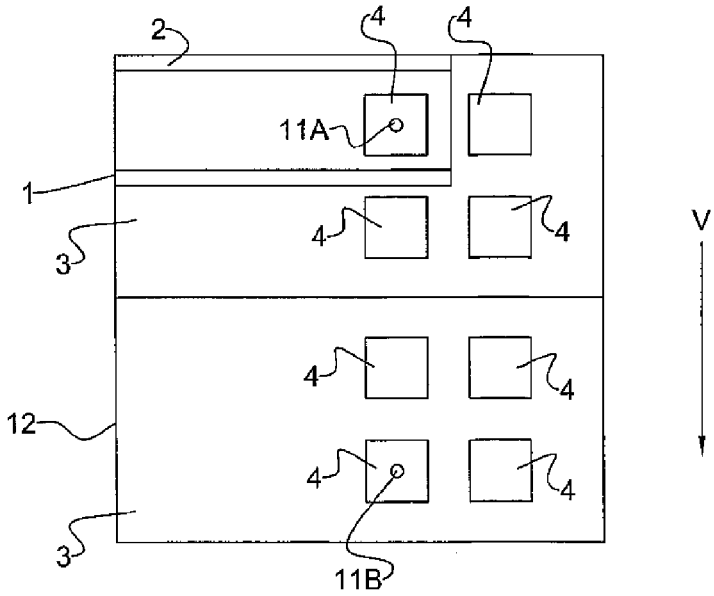
FIG. 9 shows another embodiment of the invention, wherein two pads are connected side to side resulting in a longer degree of side to side movement being available to the rig between drilling locations.

Extended Apparatus Allowing Extended Moves:

It is further contemplated that by using a pad [1] and at least one additional pad [12], the utility of the invention could be further extended, by allowing for the movement of the rig structure [6] longer distances. FIGS. 8 and 9 demonstrate two such configurations.

FIG. 8 shows an embodiment of the present invention in which the pads [1] and an additional pad [12] are used, and they are attached together in a horizontal fashion, which would allow for the extended horizontal movement of the rig base [2], for example from the drilling location aperture [4] coinciding with a first drilling location [11A], to the drilling location aperture [4] coinciding with a second drilling location [11B] at the far other end of the additional pad [12]. By attaching the additional pad [12] to the end of the pad [1], the rig structure [6] could effectively be moved all the way down the rig support surface [3] of the pad [1] and onto the rig support surface [3] of the additional pad [12] to a drilling location aperture [4] thereon.

FIG. 9 shows a similar configuration albeit in an alternate configuration or joining of the pad [1] with the additional pad [12].

It is contemplated that the present invention could also be used with a pad [1] and any number of additional pads [12] to greatly extend the range of horizontal motion of the rig structure [6]. The rig structure [6] could be moved by connecting all the pads together forming a long sliding surface for the rig structure [6].

Figure 12B:
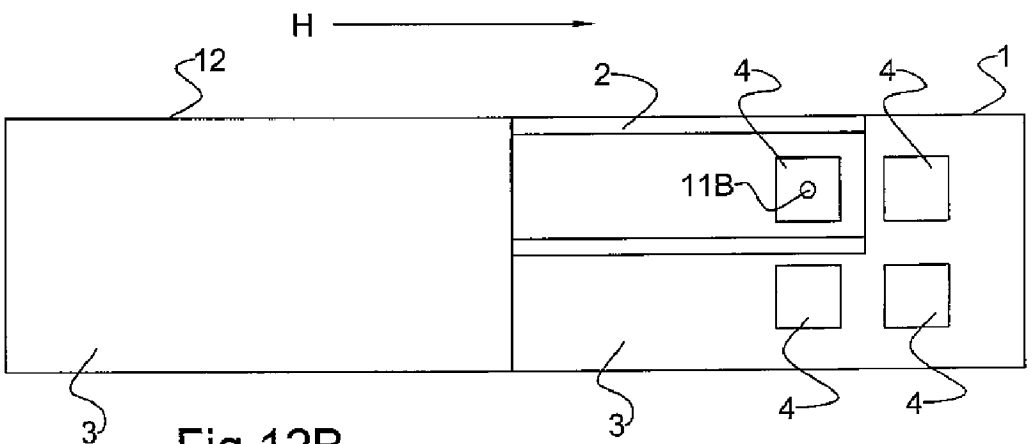
FIG. 12B shows another embodiment of the invention, wherein two pads are connected end to end resulting in a longer degree of end to end movement being available to the rig between drilling locations where one of the pad has an non-perforated surface and the rig base is located at position B.

It can be seen that by employing a pad [1] and at least one additional pad [12], the rig structure [6] which is supported on the rig base [2] could be moved relatively long distances without the requirement to disassemble the rig structure [6]. FIGS. 12A and 12B illustrate an apparatus and method allowing the rig structure to be moved relatively long distances using a pad [1] and an additional pad [12] with a non-perforated rig support surface [3], once the rig base [2] moved all the way from the first pad [1] onto the additional pad [1], as shown in FIG. 12A, the first pad could be disconnected and moved then to the opposite end of the additional pad [12] and reconnected, and potentially the rig structure could be moved right on across the additional pad [12], back onto the pad [1] which is now resting in a third position at location B, as shown in FIG. 12B. It is contemplated that the above described method and apparatus could work equally as well with an additional pad [12] that contained at least one drilling location aperture [4].

Pad with Optional Well Centers:

The apparatus of the present invention could be rendered further flexible by designing a pad [1] which had a large number of closable drilling location apertures [4] by means of a drilling location aperture cover [8] contained therein. For example a pad [1] could be manufactured where the entire base of which was a grid of drilling location apertures [4], selected ones of which well centers could be opened dependent upon where it was desired to position the rig structure [6] on the rig support surface [3] of the pad [1]. By making the drilling location apertures [4] closable, simply by providing for the placement of a drilling location aperture cover [8] over a drilling location aperture [4] and essentially extending the rig support surface [3] of the pad [1] over the drilling location aperture cover [8] when the drilling location aperture [4] was not in use, the pad [1] could be made even more universal and more flexible insofar as the addition of more drilling locations [11] to the pad [1] would make it even these here to use the apparatus of the present invention to drill even more wells without an elaborate move of the pad [1] and the rig structure [6] thereon.

Figure 7:
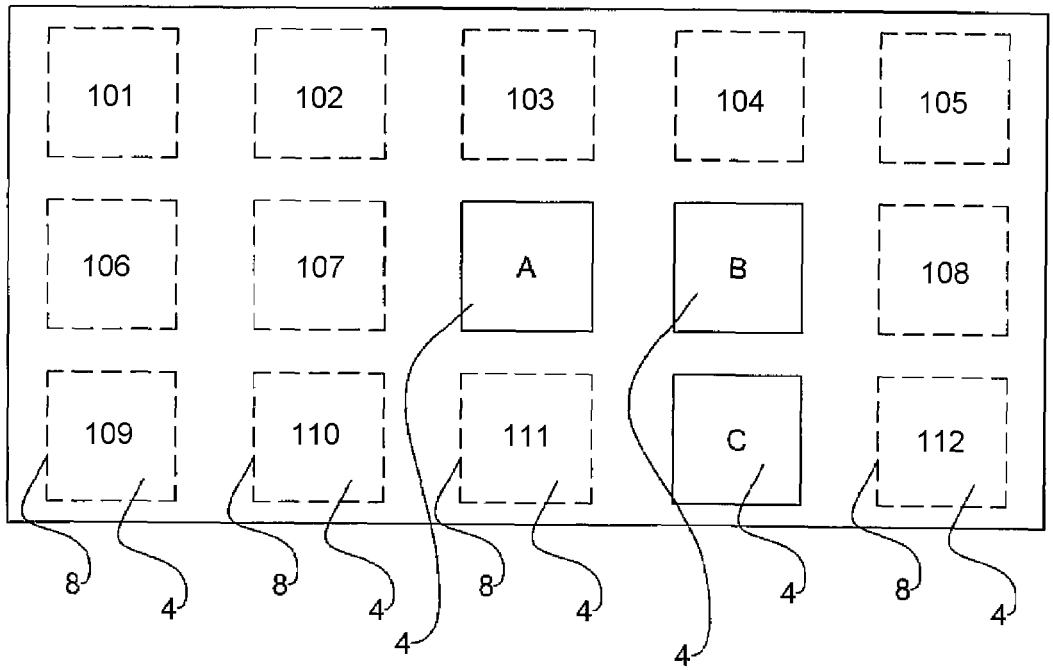
FIG. 7 is a top view of another embodiment of a pad of the present invention, with a number of closable drilling location apertures disposed thereon.

To demonstrate this possibility, FIG. 7 shows a pad [1] which has 15 drilling location apertures [4] disposed throughout in a grid pattern, with drilling location aperture covers [8] thereover. In the embodiment shown, three of the total of 15 possible drilling location apertures [4] letters A, B and C are open, with the remainder being covered (and numbered 101 through 112). By simply closing and opening other combinations of drilling location apertures [4] by means of a drilling location aperture cover [8], this pad [1] could add significant additional flexibility to the rig apparatus [5].

Adaptability of the Apparatus and Method to a Variety of Equipment:

It has already been outlined above that the primary purpose of the apparatus and method of the present invention is to provide for a method of simplified movement of a drilling rig or similar equipment between adjacent drilling locations. However it will be understood that beyond using it simply for the support and/or simplified movement of an actual rig structure [6], the method or apparatus of the present invention can also be adapted for use with other similar types of supporting equipment.

The invention is a rig apparatus [5] for the movement of a rig structure [6] or similar equipment between adjacent drilling locations [11]. This rig apparatus effectively comprises a pad [1] with a relatively planar rig support surface [3] upon which a rig structure [6] or other equipment can be slid between adjacent drilling locations 11 located thereunder by moving the rig structure [6] on the rig support surface [3] of the pad [1]. The rig support surface [3] of the pad [1] and/or the bottom surface of the rig structure [6], being the rig base [2], would be of proper materials to provide for a low friction relationship which would simplify the movement of the rig structure [6] and the rig base [2] across the rig support surface [3] of the pad [1].

The pad [1] itself would typically have a plurality of drilling location apertures [4] passing therethrough. Each drilling location aperture [4] would basically be a hole extending through the pad [1] which would allow a surface-engaging tool [7] or other type of access from the drilling equipment or rig structure [6] on top of the pad [1], through the pad [1] to the drilling surface [10] below. Any number of drilling location apertures [4] could be contained on a particular pad [1] and could be placed in a number of different patterns thereon, depending upon what the needs of the operator were.

Using a pad [1] and at least one additional pad [12], a rig structure [6] could be potentially moved relatively large distances by staggering the movement of the rig structure [6] on its rig base [2] across the rig support surface [3] of the pad [1] and the at least one additional pad [12], and as the rig structure [6] departed the surface of the last pad, disconnect that pad and moving it to the opposite end of the other pad on which the rig structure [6] was then resting to provide further room for the rig structure [6] to move as it continued.

Various methods of moving the actual rig structure [6] or equipment across the rig support surface [3] of the pad [1] could be used. Where a fixed number of drilling location apertures [4] were contained on the surface of the pad [1] one method of movement of the rig structure [6] itself which is specifically contemplated is the development or placement of a series of anchor positions [9] at appropriate positions on the rig support surface [3] of the pad [1], to which anchor positions [9] hydraulic rams could be attached, the other end of the cylinders being attached to the rig base [2] or the rig structure [6] itself and the hydraulic rams could then be extended or contracted to move the rig structure [6] in one axis of direction at one time. One of the major benefits of this particular system over the other previous systems is that in addition to the fact that this particular type of a rig apparatus [5] does not require the lifting of the rig structure [6] which adds significant safety instability to a rig structure [6] move this particular system also has the advantage of streamlining the process and decreasing the amount of necessary labor. Another major benefit of this system is that the rig structure [6] on its rig base [2] can be moved in the two directions required to accomplish a movement to any adjacent drilling location aperture [4] and, whether that requires movement of the rig structure [6] from side to side or forward and rearward in terms of the pad [1] itself.

Conventional rigs could be retrofit for use in this invention, or a customized apparatus could be designed.

Also disclosed herein and a portion of the present invention is the method of moving a rig structure [6] between adjacent drilling locations [11] as illustrated in FIGS. 4A and 4B. The method comprises providing a planar rig support surface [3] upon which the rig structure [6] can rest, with a plurality of drilling location apertures [4] extending there through. The method further comprises moving the rig structure [6] from a first drilling location [11A] at a first position [20] by a horizontal movement of the rig structure [6] across the rig support surface [3] of the pad [1] to a second drilling location [11B] at a second position [21], at which point the surface-engaging tool [7] of the rig structure [6] can be extended through the new drilling location aperture [4] to access the drilling surface [10] below.

The method of moving a rig between adjacent drilling locations using the equipment of the present invention is also contemplated within the scope hereof.

The foregoing is considered as illustrative only of the principles of the invention. Furthermore, since numerous changes in modifications will be obvious to those skilled in the art, it is not desired to limit the invention to the exact construction operation showman described, and accordingly all suitable changes in modifications and structure operation which may be resorted to are intended to fall within the scope of the claimed invention.

The invention claimed is:

1. A drilling apparatus capable of drilling in at least two drilling locations on a drilling surface, said drilling apparatus comprising:

a. a rig structure including a surface-engaging tool, said rig structure having a rig base with a substantially planar lower surface;

b. a drilling pad having a substantially planar rig support surface with at least one drilling location aperture passing therethrough, wherein said pad can be placed on the drilling surface over desired adjacent drilling locations such that each of said drilling locations coincides with a drilling location aperture, and wherein the lower surface of the rig base rests on said rig support surface;

wherein said rig structure can be positioned on said pad in a first position in alignment with a first drilling location aperture such that said surface-engaging tool can pass through said first drilling location aperture and access a first drilling location coinciding therewith;

and wherein said rig base can freely slide fore and aft and left and right and diagonally over the rig support surface of said pad, such that the rig structure can be moved from said first position to a second position in alignment with a second drilling location aperture such that said surface-engaging tool can pass through said second drilling location aperture and access a second drilling location coinciding therewith by sliding said rig base horizontally fore and aft and left and right and diagonally as required across said rig support surface from said first position to said second position.

2. The drilling apparatus of claim 1 wherein said first drilling location aperture and said second drilling location aperture are the same aperture.

3. The drilling apparatus of claim 1 wherein said first drilling location aperture and said second drilling location aperture are different apertures.

4. The drilling apparatus of claim 1 further comprising a friction-reducing coating between said rig base and said rig support surface.

5. The drilling apparatus of claim 4 wherein said friction-reducing coating comprises a friction-reducing coating on a bottom portion of said rig base.

6. The drilling apparatus of claim 4 wherein said rig base comprises pontoons having bottom surfaces thereof supported on the rig support surface.

7. The drilling apparatus of claim 6 wherein said friction-reducing coating comprises a friction-reducing coating on a bottom of said pontoons.

8. The drilling apparatus of claim 7 wherein said friction-reducing coating comprises a polymer coating.

9. The drilling apparatus of claim 8 wherein said polymer coating comprises an ultra-high molecular weight (UHMW) polymer.

10. The drilling apparatus of claim 1 wherein one of said lower surface of the rig base and said rig support surface further comprises a friction-reducing coating to reduce the force required to move said rig base in relation to said rig support surface.

11. The drilling apparatus of claim 10 wherein said friction-reducing coating is a coating which can be repaired or replaced as necessary.

12. The drilling apparatus of claim 11 wherein said friction-reducing coating is a polymer coating.

13. The drilling apparatus of claim 12 wherein said polymer coating comprises an ultra-high molecular weight (UHMW) polymer.

14. The drilling apparatus of claim 1 wherein more than one drilling location coincides with one drilling location aperture.

15. The drilling apparatus of claim 1 further comprising a rig structure moving means to facilitate the movement of said rig base across said rig support surface.

16. The drilling apparatus of claim 15 wherein said rig structure moving means comprises at least one hydraulic cylinder, said at least one hydraulic cylinder being removably attached between said rig base and said pad to allow for a pushing or pulling force to be exerted upon said rig base rendering a sliding movement of said rig structure and rig base on said rig support surface.

17. The drilling apparatus of claim 16 wherein the number of hydraulic cylinders is one.

18. The drilling apparatus of claim 16 wherein the number of hydraulic cylinders is more than one.

19. The drilling apparatus of claim 16 further comprising a plurality of anchor points on said rig support surface to allow for the removeable attachment of said at least one hydraulic cylinder to said rig support surface at different points.

20. The drilling apparatus of claim 19 further comprising a plurality of anchor points on said rig base to allow for the moveable attachment of said at least one hydraulic cylinder to said rig base at different points.

21. The drilling apparatus of claim 15 wherein said rig base moving means is attached to said pad and said rig support surface.

22. The drilling apparatus of claim 1 further comprising at least one additional pad having a rig support surface, wherein said at least one additional pad can be placed on said drilling surface adjacent to and abutting said pad and, and wherein said rig support surface of said pad and said rig support surface of said at least one additional pad are substantially in the same plane allowing said rig structure to be moved from said pad to said at least one additional pad by moving said rig base horizontally.

23. The drilling apparatus of claim of 22 wherein said at least one additional pad has at least one drilling location aperture passing therethrough, and can be placed on said drilling surface such that said at least one drilling location aperture coincides with at least one additional drilling location.

24. The drilling apparatus of claim 22 wherein said at least one additional pad has a non-perforated rig support surface.

25. The drilling apparatus of claim 22 wherein said pad and said at least one additional pad are connected.

26. The drilling apparatus of claim 22 wherein there are more than one additional pads wherein each pad abuts another pad and said rig structure can be moved to any of the pads.

27. The drilling apparatus of claim 1 wherein said pad further comprises a plurality of connectable portions.

28. The drilling apparatus of claim 1 further comprising at least one removable drilling location aperture cover adapted to cover at least one drilling location aperture.

29. A drilling pad adapter apparatus allowing a rig structure to be movable between at least two adjacent drilling locations on a drilling surface, said apparatus comprising:

a. a drilling pad comprising a substantially planar rig support surface with at least one drilling location aperture passing therethrough;

b. a rig base adapted for attachment to a bottom of the rig structure and having a substantially planar lower surface;

wherein said pad can be placed on said drilling surface over the desired adjacent drilling locations such that each of said drilling locations coincides with a drilling location aperture, and wherein the rig structure comprises a surface-engaging tool and the rig structure can be attached to the rig base with the lower surface of the rig base resting on said pad and positioned in a first position in alignment with a first adjacent drilling location aperture such that said surface-engaging tool can pass through said at least one drilling location aperture and access a first drilling location coinciding therewith;

and wherein said rig structure attached to the rig base can freely slide fore and aft and left and right and diagonally over the rig support surface of said pad, such that the rig structure can be moved from said first position to a second position in alignment with a second adjacent drilling location aperture such that said surface-engaging tool can pass through a drilling location aperture and access a second drilling location coinciding therewith, by sliding the rig base horizontally fore and aft and left and right and diagonally as required across said rig support surface from said first position to said second position.

30. The apparatus of claim 29 wherein one of said lower surface of the rig base and said rig support surface further comprises a friction-reducing coating to reduce the force required to move said rig base in relation to said rig support surface.

31. The apparatus of claim 30 wherein said friction-reducing coating comprises a coating which can be repaired or replaced as necessary.

32. The apparatus of claim 31 wherein said friction-reducing coating comprises a polymer coating.

33. The apparatus of claim 32 wherein said friction-reducing coating comprises an ultra-high molecular weight polymer.

34. The apparatus of claim 29 wherein more than one drilling location coincides with one drilling location aperture.

35. The apparatus of claim 29 wherein the rig base comprises a plurality of pontoons adapted for attachment to a bottom of said rig structure.

36. The apparatus of claim 35 wherein the pontoons comprise a polymer coated friction reducing bottom surface adapted to rest on the rig support surface.

37. A method of moving a rig structure on a drilling surface between adjacent drilling locations, said method comprising the steps of:

a. providing a drilling pad having a substantially planar rig support surface with a plurality of drilling location apertures passing therethrough, wherein said drilling pad is placed on said drilling surface over desired adjacent drilling locations such that each of the desired drilling locations coincides with a drilling location aperture;

b. placing a substantially planar lower surface of a rig structure on said rig support surface, said rig structure including a surface-engaging tool;

c. sliding said rig structure horizontally fore and aft and right and left and diagonally as required across said rig support surface as required until said rig structure is aligned with a selected drilling location aperture coinciding with a desired drilling location such that the surface-engaging tool can access the desired drilling location through said selected drilling location aperture.

38. The method of claim 37 further comprising placing at least one additional drilling pad adjacent and abutting said drilling pad, said at least one additional drilling pad having an approximately planar rig support surface with at least one drilling location aperture passing therethrough, wherein said at least one additional drilling pad is placed on said drilling surface such that said rig support surface of said at least one additional pad and said rig support surface of said drilling pad are substantially in the same plane, and wherein the rig structure is moved horizontally from said rig support surface of said drilling pad to said rig support surface of said at least one additional pad to align the surface-engaging tool with additional drilling locations through at least one additional drilling location in the additional drilling pad.

39. The method of claim 38 wherein the rig structure is mounted on a rig base comprising a friction-reduced surface on a bottom thereof to facilitate horizontal movement of the rig structure across said rig support surface.

* * * * *